US005931690A

United States Patent [19]

Sai et al.

[11] Patent Number: 5,931,690

[45] Date of Patent: Aug. 3, 1999

[54] ELECTRICAL CONNECTOR

[75] Inventors: Noriaki Sai, Yokohama; Toru Takeda, Wako, both of Japan

[73] Assignee: The Whitaker Corporation, Wilmington, Del.

[21] Appl. No.: 08/668,113

[22] Filed: Jun. 21, 1996

[30] Foreign Application Priority Data

Jun. 21, 1995 [JP] Japan ..... 7-154602

[51] Int. Cl.[6] ..... H01R 13/73

[52] U.S. Cl. ..... 439/350; 439/854; 439/522

[58] Field of Search ..... 439/350, 352, 439/522, 854, 843, 881, 606, 604

[56] References Cited

U.S. PATENT DOCUMENTS 5,288,242 2/1994 Muzslay ..... 439/349
5,314,345 5/1994 Cahaly et al. ..... 439/352
5,346,407 9/1994 Hood ..... 439/522
5,435,754 7/1995 Hotea et al. ..... 439/854
5,529,512 6/1996 Mlyniec ..... 459/352
5,586,902 12/1996 Hoff et al. ..... 439/352

*Primary Examiner*—Hien Vu
*Attorney, Agent, or Firm*—Bradley N. Ditt

[57] ABSTRACT

The purpose of this invention is to provide an electrical connector for attachment to post-type terminals of electrical equipment which would allow for an easy attachment to the terminals and would cover the terminals in a fully-connected state. This is accomplished by a terminal (22) made by bending a blank stamped from a conductive sheet material and it comprises a first tubular section (22*a*) in which a core (21*a*) of cable (21) is secured by crimping and of a second tubular section arranged approximately perpendicularly to the first tubular section. The terminal (22) mounted to an inner housing (23) and the cable core (21) secured thereto are enveloped in an outer housing (26) by an over-molding method. The outer housing (26) has openings (26*c*) which engage latching arms (13) of the battery (10) when the second tubular section (22*b*) is placed over the post-type terminal (11).

11 Claims, 7 Drawing Sheets

Fig. 4
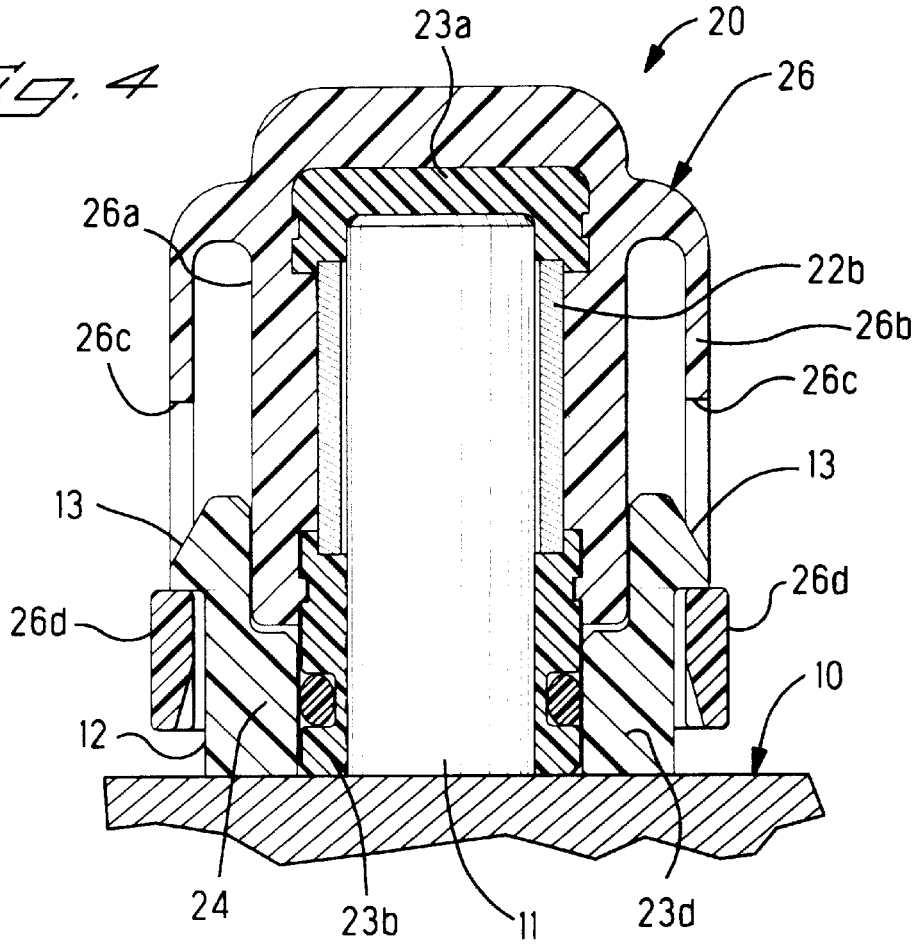
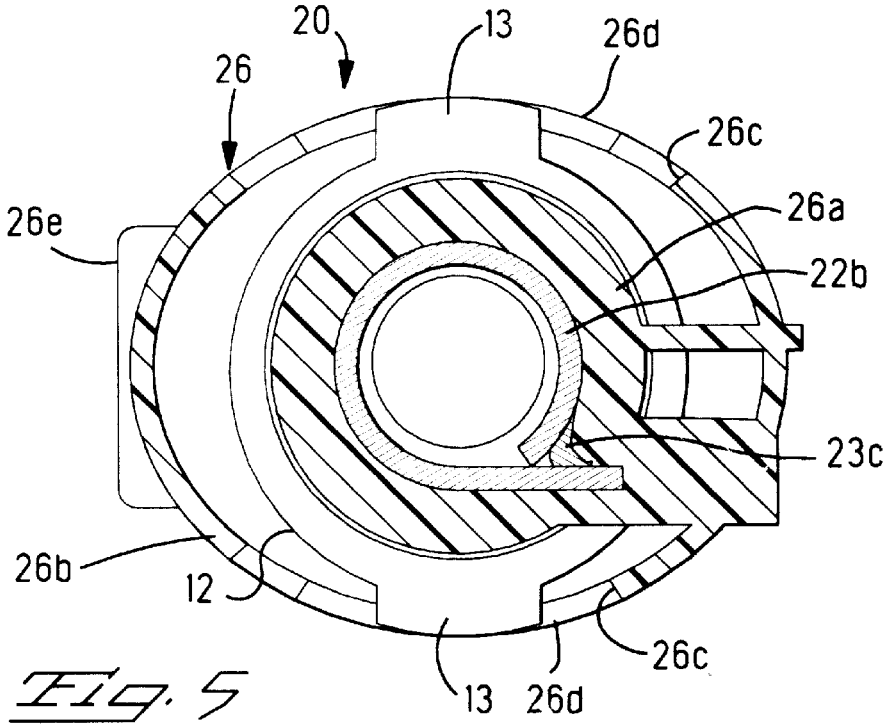
Fig. 5

ELECTRICAL CONNECTOR

FIELD OF THE INVENTION

This invention relates to electrical connectors intended for forming electrical connections between cables and post-type terminals of electrical equipment, especially with post terminals of batteries.

BACKGROUND OF THE INVENTION

Connectors of this type intended for electrical connection between cables and post contacts of batteries are described, for example, in Japanese Patent Publication No. 86-13351. This electrical connector comprises a round clamp forming electrical connection with a post terminal which is secured on the terminal by means of a fixture including a bolt and a nut. When this electrical connector is placed on the post terminal, the post terminal is inserted in the round clamp, after which the electrical connector is secured on the post terminal by operating the tightening device, thus fixing the round clamp.

Electrical connectors of this type, including the connectors described in the above Patent Publication, can be secured on the post terminals only by tightening special fixtures provided for this purpose, thus making this operation rather time consuming.

Another disadvantage of conventional electrical connectors consists in the fact that the contact element forming electrical connection with the post terminal is exposed, and unless it is protected by a separate cover, there is a danger that the battery can be accidentally discharged if the contact element comes in contact with conductive material.

Considering the above mentioned circumstances, the purpose of this invention is to offer an electrical connector providing for an easy placement over the post terminal; and, at the same time, not requiring a separate cover to protect the contact element.

SUMMARY OF THE INVENTION

In order to achieve the purposes stated above, the electrical connector according to this invention includes a terminal that is made of a first tubular section connected to a cable core, a second tubular section receiving a post-type terminal of electrical equipment and forming electrical connection with it, and an insulating housing enveloping both the second tubular section and the first tubular section connected to the cable core, and the insulating housing is equipped with locking elements which engage with locking elements of the electrical equipment when the second tubular section is placed over the post-type terminal.

In addition, the terminal is made of a single sheet of a conductive material, and the first tubular section and the second tubular section are arranged approximately perpendicularly to each other.

The electrical connector according to this invention also comprises a metal terminal having a first tubular section connected to a cable core and a second tubular section arranged approximately perpendicular to the first tubular section and intended to form electrical connection with a post-type terminal of electrical equipment, and a resilient insulating housing covering the first tubular section and sheathing the second tubular section by a double-wall circular structure, with an outside circular shell of the circular structure being provided with locking elements which can be engaged or disengaged with locking elements of the electrical equipment by bending the circular shell.

In the electrical connector according to this invention, the locking elements of the insulating housing engage the locking elements of the electrical equipment when the second tubular section of the terminal is placed over the post-type terminal of the electrical equipment, and retain both terminals in the connected state.

The electrical connector according to this invention makes it unnecessary to use tightening devices employed in conventional electrical connectors, it becomes locked just by placing the second tubular section over the post-type terminal, thus greatly facilitating the task of the attachment and securing of the electrical connector to the post-type terminal.

The terminal is covered with an insulating housing, and when the second tubular section is placed over the post-type terminal, the contacting parts of the post-type terminal and the electrical connector become also covered by the insulating housing. This makes it possible to prevent an accidental contact of the post-type terminal with other conductive parts without placing a separate cover after the electrical connector has been attached to it.

Due to the fact that the terminal is manufactured from a sheet material, the production process is easy and inexpensive, thus making it possible to mass produce the terminal at a low cost. In addition, since the first and the second tubular sections are arranged perpendicular to each other, the cable can be placed perpendicularly to the direction of the post-type terminals, thus reducing the height of the profile of the connection hardware.

If the insulating housing is made by the over-molding method, it is possible to achieve a tight joining between the terminal and the insulating housing, thus improving waterproof characteristics of the electrical connector. In order to facilitate the production of the insulating housing by the over-molding method, one end of the second tubular section is covered by a cap.

The design of the locking elements employs elastic deformation. Due to the fact that releasing of the locking device is also done by subjecting it to elastic deformation, the electrical connector can be easily removed from the post-type terminal.

BRIEF DESCRIPTION OF THE DRAWINGS

Embodiments of the present invention will now be described by way of example with reference to the accompanying drawings in which:

FIG. 4 is a cross-sectional view taken along line 4—4 of FIG. 2.

FIG. 5 is a cross-sectional view taken along line 5—5 of FIG. 3.

DETAILED DESCRIPTION OF THE INVENTION

Figure 1:
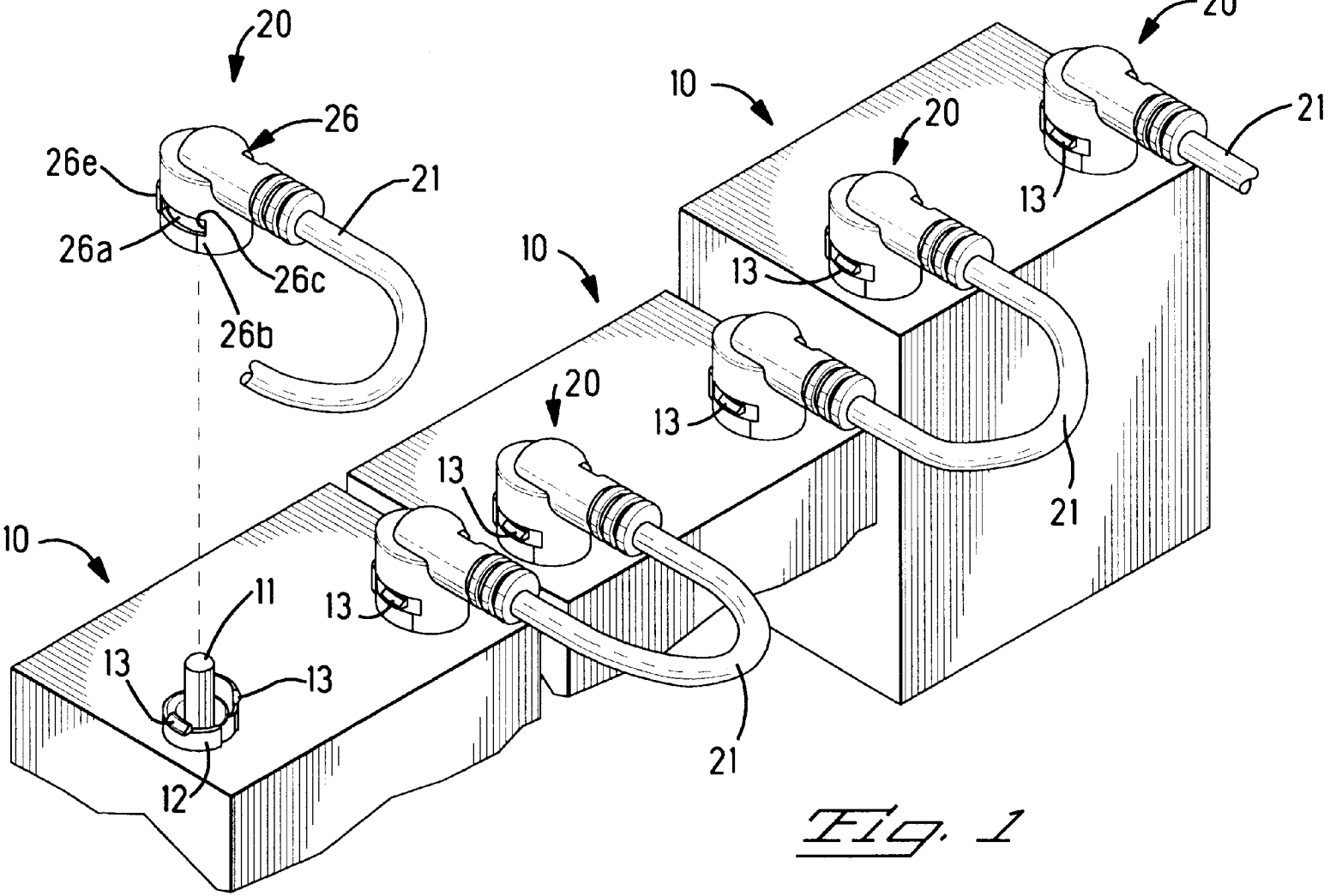
FIG. 1 is a perspective view of an electrical connector according to the present invention with a connector exploded from electrical equipment to which it is to be connected.
Figure 2:
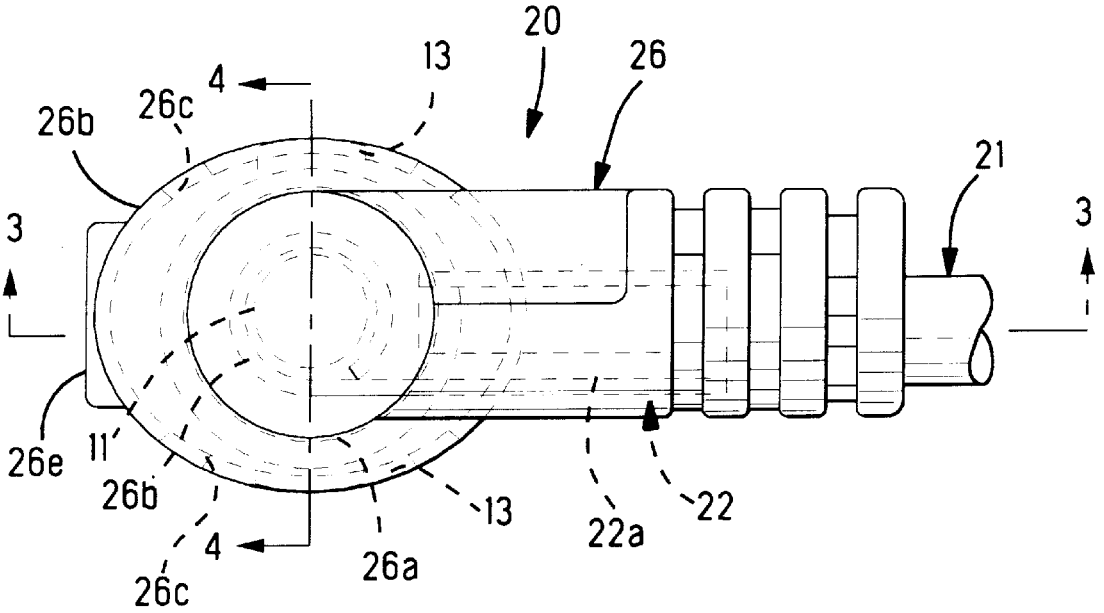
FIG. 2 is a top plan view of the connector.

FIG. 1 is a perspective view showing an embodiment of an electrical connector according to this invention wherein connectors therefore are used to connect batteries 10. These batteries 10 are used as a power source in an electric car, and each of them has two post-type terminals 11 on its upper surface. In addition, ring-shaped elements 12 surrounding post-type terminals 11 are provided on the upper surface of the battery 10. In the upper portion of these ring-shaped elements 12, paired latching arms 13 are provided which are located on opposite sides of the post-type terminals 11.

Electrical connectors 20 according to this embodiment are used for the electrical connection of post-type terminals 11 of adjacent batteries 10 by means of cable 21. Electrical connector 20 is shown in FIGS. 2 through 5.

Figure 6:
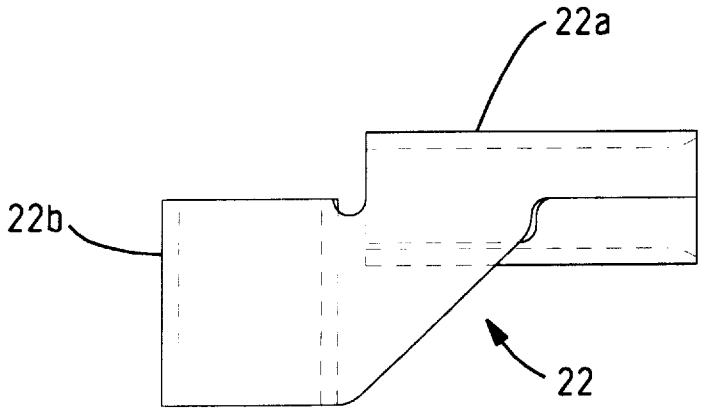
FIG. 6 is a side elevational view of the terminal.
Figure 7:
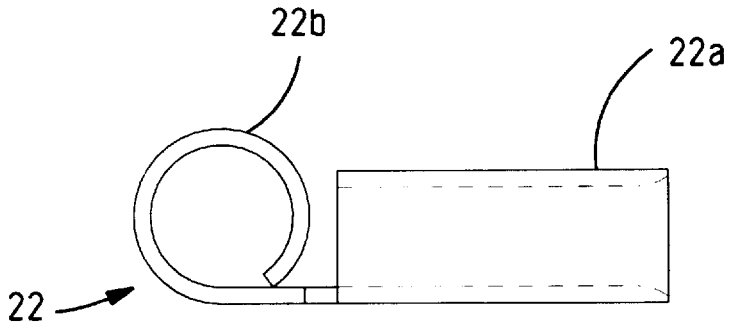
FIG. 7 is a top plan view of the terminal.
Figure 8:
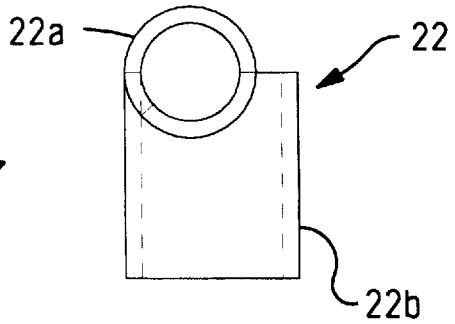
FIG. 8 is a front view of the terminal when viewing FIG. 7 from the right.
Figure 9:
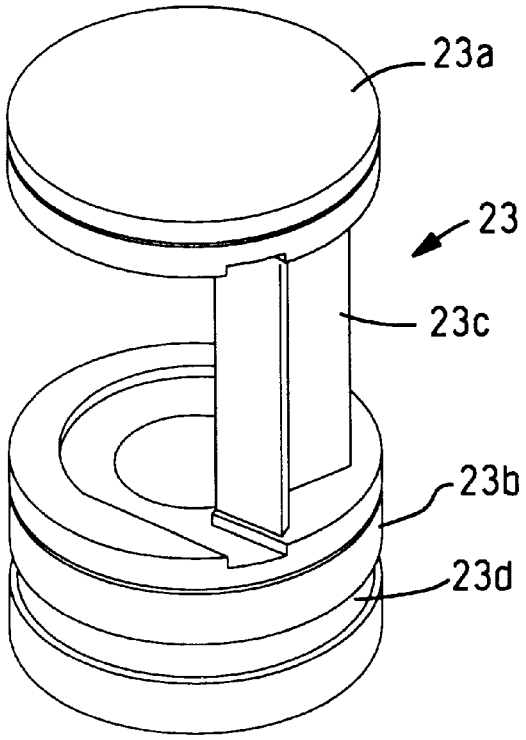
FIG. 9 is a perspective view of an inner housing of the connector as shown in FIG. 3.

Electrical connector 20 contains a terminal 22 including a first tubular section 22*a* to which core 21*a* of cable 21 is connected and a second cylindrical section 22*b* which is to be connected with post-type terminal 11. Terminal 22 is shown in FIGS. 6–8. Terminal 22 is made by stamping a blank of the required shape from a copper sheet, after which the first and second cylindrical sections 22*a*, 22*b* are formed by bending to the required configuration. This simple method makes it possible to manufacture terminals 22 at a low cost.

The terminals 22 can be manufactured not from copper only, but from other suitable electrically conductive materials. In this embodiment, the connection of the cable core 21*a* to the first tubular section 22*a* is done by inserting the cable core 21*a* inside the first tubular section 22*a* with a subsequent bending of the circumference of the first tubular section 22*a* at two locations, thus double crimping the cable core 21*a* in such a way as to produce a W-shaped cross-sectional configuration. However, other methods of connection can be also used.

Figure 3:
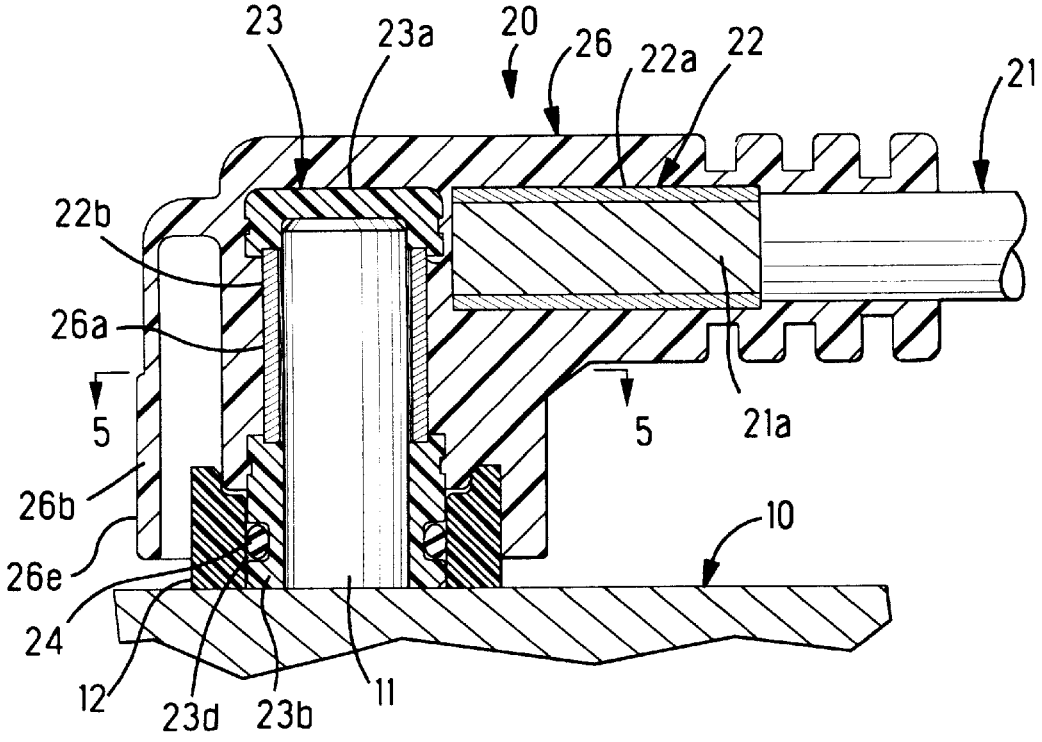
FIG. 3 is a cross-sectional view taken along line 3—3 of FIG. 2.

As can be seen in FIG. 3, an inner dielectric housing 23 is attached to the upper and lower ends of the second tubular section 22*b*. This inner housing 23 is shown in FIG. 7 As can be seen in FIG. 7, the inner housing 23 comprises a cover-shaped cap 23*a* and a cylindrical sleeve 23*b* joined by a connecting member 23*c*.

As can be seen in FIG. 3, inner housing 23 is fixed in such a manner that the cap 23*a* blocks the opening of the second tubular section 22*a* at its upper end and the sleeve 23*b* extends downward from its lower end. On the outer surface of the sleeve 23*b*, a groove 23*d* accommodating a sealing ring 24 is located. When the electrical connector 20 is attached to the post-type terminal 11, the sealing ring 24 forms a water-proof connection with the inner surface of the ring-shaped structure 12 of the battery 10.

Figure 10:
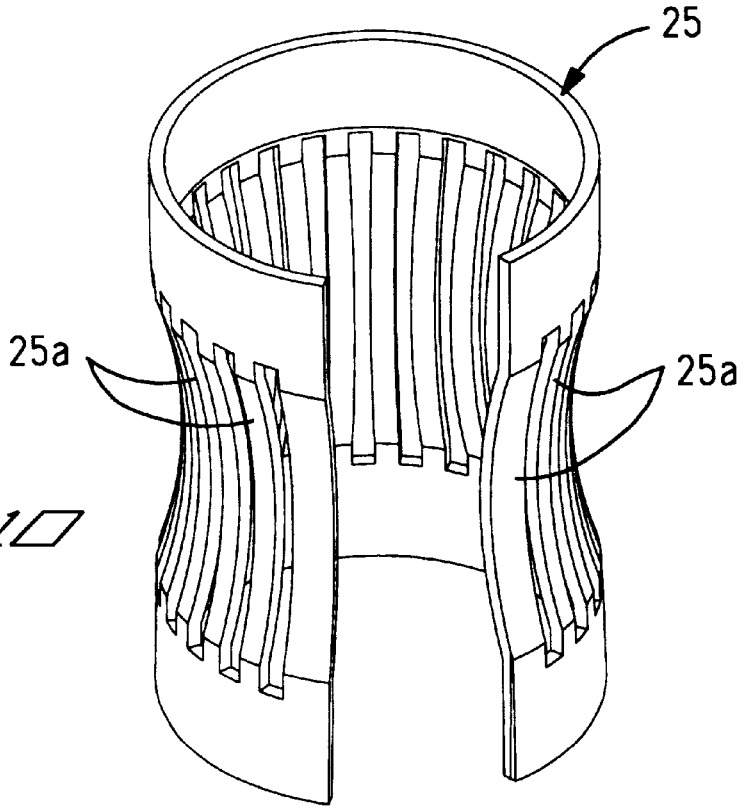
FIG. 10 is a perspective view of a contact insert.
Figure 11:
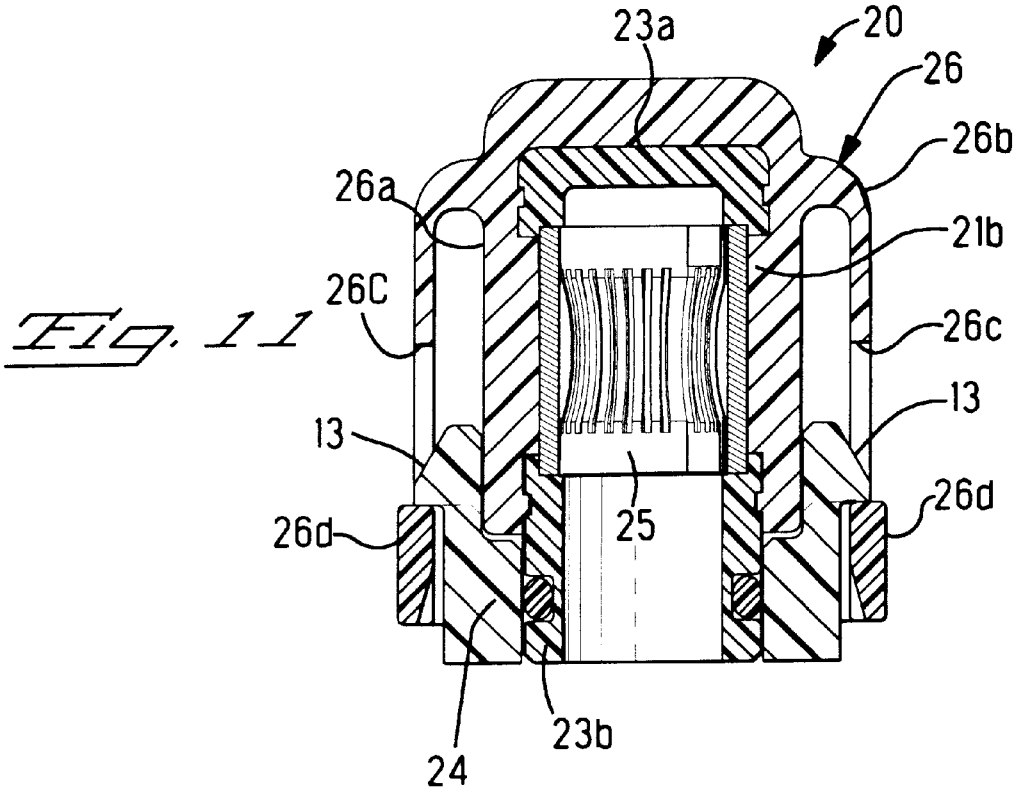
FIG. 11 is a cross-sectional view of an alternative-embodiment of the electrical connector containing the contact insert of FIG. 10.

In the space between the cap 23*a* and the sleeve 23*b*, a contact insert 25 (shown in FIG. 10) is placed (not shown in FIG. 3). As can be seen in FIG. 11, this contact insert 25 is placed against the inside wall of the second tubular section 22*b*. When the second tubular section 22*b* is placed over the post-type terminal 11, the contact insert 25 made of a conducting material directly engages with the post-type terminal 11, thus forming electrical connection between the post-type terminal 11 and the second tubular section 22*b*. As can be seen in FIG. 10, the contact insert 25 has vertical slits 25*a* and its midsection is bent inwardly which makes it possible to form a reliable electrical connection.

Terminal 22 together with a portion of the cable 21 whose core 21*a* is crimped in the first tubular section 22*a*, as shown in FIG. 3, is covered by an insulating outer housing 26. This outer housing 26 is made by an over-molding method, that is the terminal 22 (to which the cable core 21*a* is connected) with the inner housing 23 attached is placed in a metal mold (not shown in the drawing) which is filled with molten resin so that the terminal 22 and inner housing 23 becomes enveloped in the housing. As a result of this, the outer housing 26 closely adheres to the terminal 22, the cable 21 and the inner housing 23, thus providing for excellent water-proof characteristics. The cap 23*a* of the inner housing 23 prevents the molten resin from penetrating inside of the second tubular section 22*b* during the molding process of the outer housing 26.

As can be seen in FIG. 5, the outer housing 26 comprises a base shell 26*a* covering the second tubular section 22*b* of the terminal 22 and a bell-shaped covering shell 26*b* surrounding the base shell 26*a*. As can be seen from FIG. 4, the covering shell 26*b* and the base shell 26*a* are molded as integral parts of a single unit connected together in an upper section.

Openings 26*c* are provided in the covering shell 26*b* as shown in FIG. 5 which are arranged in pairs on opposite sides of the base shell 26*a*.

The covering shell 26*b* plays the role of the locking device as defined in this invention. When the electrical connector 20 is being placed over the post-type terminal 11, the edges 26*d* of the shell located below the openings 26*c* of the covering shell 26*b* are bent outwards and then return to their original position. As a result, the latching arms 13 become locked in the openings 26*c* as shown in FIG. 4. Since the openings 26*c* are made wider than the latching arms 13, the electrical connector 20 can be rotated to a certain angle when the latching arms 13 are engaged with the openings 26*c*. As can be seen in FIG. 5, the covering shell 26*b* is elliptical in cross section. Therefore, if in the state when the openings 26*c* are engaged with the latching arms 13, the plates 26*e* located at the opposite ends of the long axis of the circumference can be pressed inwardly. This action causes the covering shell 26*b* to bend, thereby disengaging the openings 26*c* from the latching arms 13.

The above mentioned second tubular section 22*b* can be connected to the post-type terminal 11 either directly or indirectly by means of an intermediate conductive member. In order to increase the contact pressure applied to the post-type terminal by the second tubular section or by the intermediate member placed between the second tubular section 22*b* and the post-type terminal 11, these parts can be treated, for example, in a manner increasing their resilience. This makes it possible to improve the retention of the second tubular section on the post-type terminal.

Below, the operation taking place in the process of the attachment of the electrical connector 20 to the post-type terminal 11 will be explained.

At the time of the attachment of the electrical connector 20 to the post-type terminal 11, the electrical connector 20 is placed over the top of the post-type terminal 11 so that the latter passes through the sleeve 23*b* of the inner housing 23 into the second tubular section 22*b*. When this action takes place, the edges 26*d* located below the openings 26*c* of the covering part 26*b* are first bent outward by the latching arms 13, after which they snap back due to their resiliency, thus engaging the openings 26*c* with the latching arms 13. This provides for tight engagement of the electrical connector 20 to the post-type terminal 11 thereby making a tightening procedure unnecessary.

Inside the second tubular section 22*b*, the post-type terminal 11 is electrically connected to the second tubular section 22*b* through the contact insert 25, thus effecting the electrical connection of the cable 21 to the post-type terminal 11. When the electrical connector 20 is attached to the post-type terminal 11, the post-type terminal 11 becomes completely enclosed by the inner housing 23 and the outer housing 26. This prevents the post-type terminal from contact with other conductive objects. The electrical connector 20, in the state when it is attached to the post-type terminal 11, can be rotated within a certain angle. Therefore, if an external force is applied to the electrical connector 20, the reaction force is not transferred to the contact area between the post-type terminal 11 and the contact insert 25, thus protecting the contact insert 25 from damage.

In order to remove the electrical connector 20 from the post-type terminal 11, the plates 26*e* of the covering shell 26*b* are pressed inwardly, thus bending the covering shell 26*b*. This results in disengagement of the openings 26*c* from the latching arms 13, after which the electrical connector 20 can be pulled off the post-type terminal 11, This provides for an easy attachment and removal of the electrical terminal 20 to and from the post-type terminal 11.

Figure 12:
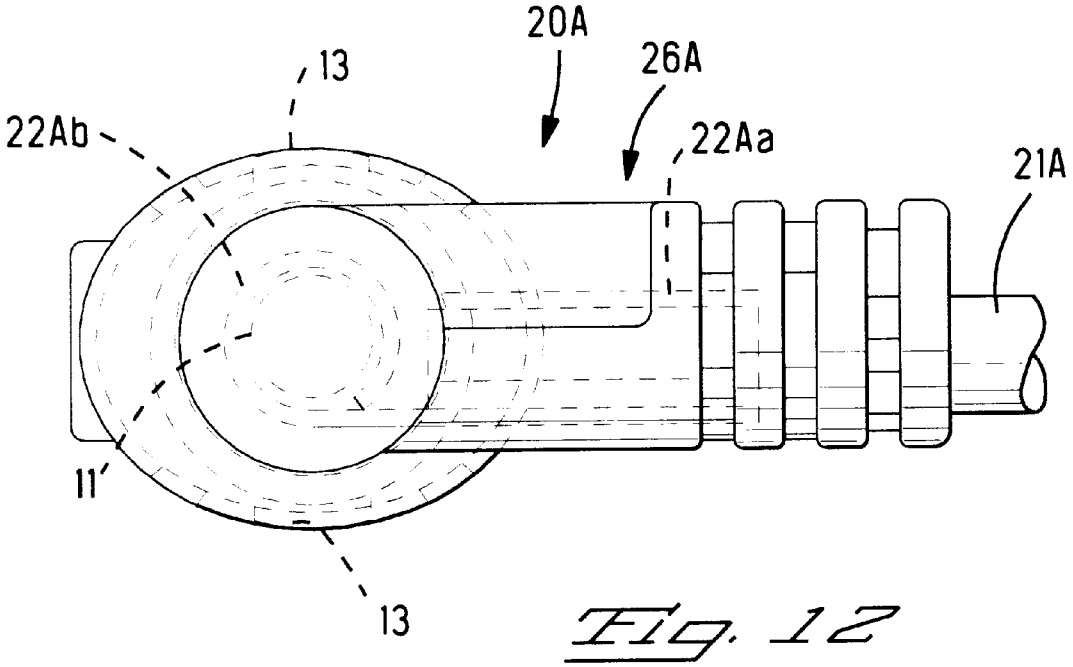
FIG. 12 is a top plan view of another alternative embodiment of the electrical connector.
Figure 13:
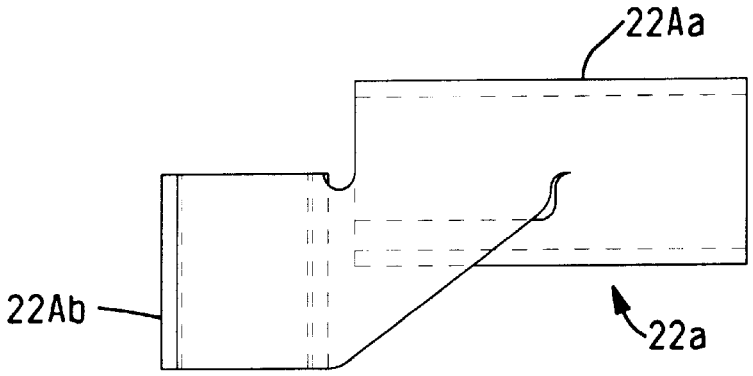
FIG. 13 is a side elevational view of the terminal used in FIG. 12.
Figure 14:
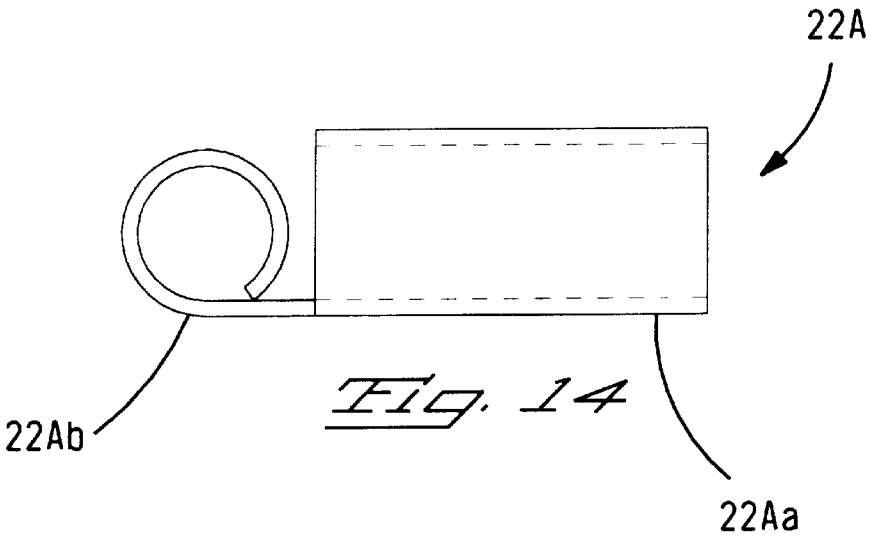
FIG. 14 is a top plan view of the terminal.
Figure 15:
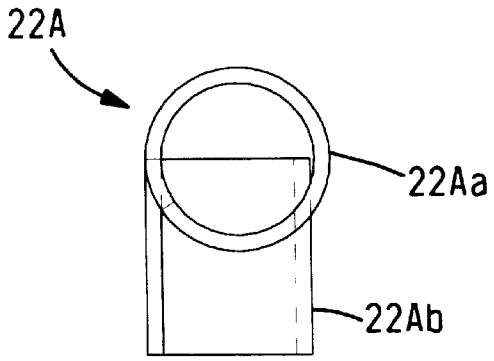
FIG. 15 is a front view of the terminal when viewing FIG. 14 from the right.

FIG. 12 represents a modified version 20A of the electrical connector 20. This electrical connector 20A is designed for cables 21A having a larger diameter than cables 21. As can be seen from FIGS. 13–15, the first tubular section 22A*a* of the terminal 22A has a larger diameter than the first tubular section 22*a* of the terminal 22, whereas the second tubular section 22A*b* is the same size as second tubular section 22*b*. The outer housing 26A of this modified connector is made by molding using the same mold that is used for the manufacturing of the outer housing 26 of the electrical connector 20. Therefore, it is possible to produce the outer housing for the connectors intended for cables having cores of different diameters using only one mold, thus allowing for the production in large quantities at a low cost.

Explanations concerning embodiments of the electrical connector according to this invention used for the connection of batteries have been set forth; however, it is obvious that this invention is also applicable to electrical connectors used for the connection of various types of electrical equipment and it is not limited to the specific case described above.

We claim:

1. An electrical connector for electrical connection with a post-type terminal of electrical equipment comprising an electrical terminal having a first tubular section for electrical connection to an electrical cable and a second tubular section for electrical connection to the post-type terminal, characterized by the fact that:

said first tubular section is disposed at an angle to said second tubular section;

an insulating housing covers the first tubular section and the second tubular section;

latching members provided by the insulating housing for latching engagement with latching elements of the electrical equipment when the second tubular section is electrically connected with the post-type terminal;

an inner dielectric housing is located within said insulating housing and has attachment portions which are attached to upper and lower ends of the second tubular section of the terminal; and wherein the insulating housing includes a base shell covering the second tubular section of the terminal and a bell-shaped covering shell surrounding the base shell and containing the latching members.

2. An electrical connector as claimed in claim 1, wherein the first tubular section is substantially perpendicular to the second tubular section.

3. An electrical connector as claimed in claim 1, wherein the covering shell has an elliptical shape.

4. An electrical connector as claimed in claim 1, wherein a contact insert is located within the second tubular section of the terminal.

5. An electrical connector as claimed in claim 1, wherein the inner dielectric housing has a groove in an outer surface accommodating a sealing ring.

6. An electrical connector as claimed in claim 1, wherein the insulating housing is overmolded onto the inner dielectric housing and the electrical terminal.

7. An electrical connector for electrical connection with a post-type terminal of electrical equipment, comprising:

an electrical terminal having a first tubular section for electrical connection to an electrical conductor and a second tubular section for electrical connection to the post-type terminal, said first tubular section disposed at an angle to said second tubular section;

an angular insulating housing covering the first tubular section, the second tubular section and part of the conductor when the conductor is connected to the first tubular section, wherein the insulating housing is overmolded onto the electrical terminal;

latching members provided by said insulating housing for latching engagement with latching elements of the electrical equipment when the second tubular section is electrically connected with the post-type terminal;

an inner dielectric housing is located within the housing insulating housing and has attachment portions which are attached to upper and lower ends of the second tubular section of the electrical terminal.

8. An electrical connector as claimed in claim 7, wherein the insulating housing includes a base shell covering the second tubular section of the electrical terminal and a covering shell surrounding the base shell.

9. An electrical connector as claimed in claim 7, wherein a contact insert is located within the second tubular section of the electrical terminal.

10. An electrical connector as claimed in claim 7, wherein the insulating housing is overmolded onto the inner dielectric housing and the electrical terminal.

11. An electrical connector as claimed in claim 7, wherein the first tubular section is substantially perpendicular to the second tubular section.

* * * * *